US005595171A

United States Patent [19]

Makin

[11] Patent Number: 5,595,171

[45] Date of Patent: Jan. 21, 1997

[54] APPARATUS FOR HEATING CONCRETE

[76] Inventor: Colin Makin, 323 Woodhaven Place, S.W., Calgary, Alberta, Canada, T2W 5P4

[21] Appl. No.: 158,645

[22] Filed: Nov. 29, 1993

[51] Int. Cl.[6] ..... F23L 9/00

[52] U.S. Cl. ..... 126/271.1; 126/626; 126/665; 165/136; 165/171

[58] Field of Search ..... 165/136, 56, 171; 126/624, 626, 665, 271.1

[56] References Cited

U.S. PATENT DOCUMENTS

| | | | |
|---|---|---|---|
| 1,800,150 | 4/1931 | Musgrave et al. | 165/136 |
| 2,262,704 | 11/1941 | Tompkins et al. | 126/271.1 |
| 2,558,345 | 6/1951 | Dickman | 165/171 |
| 2,567,716 | 9/1951 | Kritzer | 165/171 |
| 3,039,453 | 6/1962 | Andrassy | 126/665 |
| 3,918,430 | 11/1975 | Stout et al. | 126/665 |
| 4,026,350 | 5/1977 | Zembrzuski | 126/271.1 |
| 4,059,095 | 11/1977 | Grundmann et al. | 126/624 |
| 4,287,876 | 9/1981 | Jacques | 126/624 |
| 4,306,616 | 12/1981 | Woods et al. | 165/136 |
| 4,510,920 | 4/1985 | Walmet | 126/624 |
| 4,723,598 | 2/1988 | Yoshio et al. | 165/136 |
| 4,865,120 | 9/1989 | Shiroki | 165/171 |

FOREIGN PATENT DOCUMENTS

| | | | |
|---|---|---|---|
| 225229 | 12/1984 | Japan | 165/56 |
| 2083605 | 3/1984 | United Kingdom | 165/56 |

OTHER PUBLICATIONS

U.S. Statutory Invention Registration H239 Mar. 3, 1987 to Franklin et al.

*Primary Examiner*—Carroll B. Dority

*Attorney, Agent, or Firm*—Kent A. Herink, Esq.; Davis, Brown, Koehn, Shors & Roberts, P.C.

[57] ABSTRACT

A heating apparatus for assisting in the curing of concrete includes a heater and pump for providing a supply of heated fluid to a network of tubing arranged on the back or non-working side of a concrete form. The heated fluid is used to maintain a desired temperature of the curing concrete to reduce the cure time and/or accelerate the strength gain of the curing concrete. In an alternative embodiment, a heated concrete blanket includes a flexible sheet material on the back side of which is arranged a network of tubing through which heated fluid is distributed. The flexible blanket is used to cover curing concrete and regulate the temperature adjacent to the curing concrete. In both embodiments, insulating material may be used to cover the network of tubing on the back side of the apparatus to prevent undesired heat loss.

3 Claims, 3 Drawing Sheets

GRAPH OF CONCRETE TEMPERATURE V/S TIME

APPARATUS FOR HEATING CONCRETE

BACKGROUND OF THE INVENTION

The invention relates generally to apparatus for heating wet or curing concrete and, more particularly, to apparatus for heating a concrete form or blanket to speed the curing time of freshly poured concrete adjacent the form or blanket.

Concrete is, of course, a ubiquitous building material due to its low cost, high strength in compression, durability, and adaptability to a wide variety of geometries. Concrete may either be pre-cast at a site remote from where it is to be installed or may be cast in place typically through the use of reusable concrete forms. Particularly when being cast in place, the concrete is subject to the environmental conditions of the construction site at the time of construction. Unless protected in some manner, the curing concrete is, accordingly, subject to less than optimum curing conditions, such as rain, cold, heat, humidity, and so forth. The cure time, strength during curing, and final strength of the concrete are all functions of these environmental conditions.

Of particular concern is the inverse relationship between curing time and temperature. That is, the lower the temperature, in general, the longer the time it takes for the concrete to cure. At sufficiently low temperatures, moreover, the water in the fresh concrete may freeze. The frozen water may result in heaving of the partially set concrete and its surrounding forms. Further, the water in its frozen state will not be available as required for curing of the concrete.

While heating of curing concrete may be required under certain conditions because of excessively low ambient temperatures, heating may also be done in warmer conditions where it is desired to accelerate the strength gain in the curing concrete. Strength gain and curing time are the primary factors which affect the turn-around time of concrete forming apparatus. Only when the curing concrete has reached a sufficient strength and state of cure may the forms be stripped for reuse in another section of the structure. Turn-around or recycle time is of particular concern in civil engineering projects, such as bridges, where the structure will be closed to use during construction.

Current methods of heating fresh or curing concrete typically employ make-shift temporary structures having a relatively large interior volume that is heated with portable heaters. The framework of these temporary structures is usually constructed from scrap frame lumber which is loosely covered with a sheet material such as polyethylene. The Construction of these temporary structures makes inefficient use of labor and have heat losses commonly in the range of 95 percent. The cost of labor and materials often preclude the building of higher quality shelters with adequate insulation and air seals. Accordingly, the prior art systems suffer from the defects of a high cost of construction, high maintenance due to weather damage, the necessity of alterations to provide access to the interior, high energy losses due to lack of insulation and the infiltration of cold air or escape of hot air, unequal heat distribution resulting in cold air at the bottom of the enclosure where the majority of the concrete is usually found, and the impairment of safety due to reduction in air quality and increased risk of fire.

SUMMARY OF THE INVENTION

The invention consists of a portable heater and fluid pump which provides a supply of heated fluid to a network of tubing arranged on the back side of a form for concrete. The heat in the fluid is used to warm the concrete form and, in turn, the curing concrete in proximity to the form. The amount of heating of the curing concrete is controlled by adjusting either the temperature or the flow rate of the fluid through the network of tubing, or both. Insulating material is applied to the back of the form and overlying the network of tubing to prevent loss of heat.

In an alternative embodiment, the network of tubing is arranged on the back side of a flexible sheet. Insulative material is also applied to the back side of the sheet overlying the network of tubing. The resulting flexible heating blanket is used to cover and actively heat or insulate the curing concrete. Alternatively, no covering flexible sheet is used and the tubing is attached to a face of the insulative material and exposed.

An object of the invention is to provide heated concrete forms for the safe and efficient heating of curing concrete.

Another object of the invention is to provide heated concrete forms for accelerating the strength gain of curing concrete and shortening the total cure time of the concrete.

A further object of the invention is to provide a flexible heating blanket which can be used to control the temperature of curing concrete of diverse geometries and over areas which are not adjacent to a concrete form.

These and other objects of the invention will be made apparent to a person of ordinary skill in the art upon a review and understanding of the associated drawings and specification and attached claims.

DETAILED DESCRIPTION OF A PREFERRED EMBODIMENT

Figure 1:
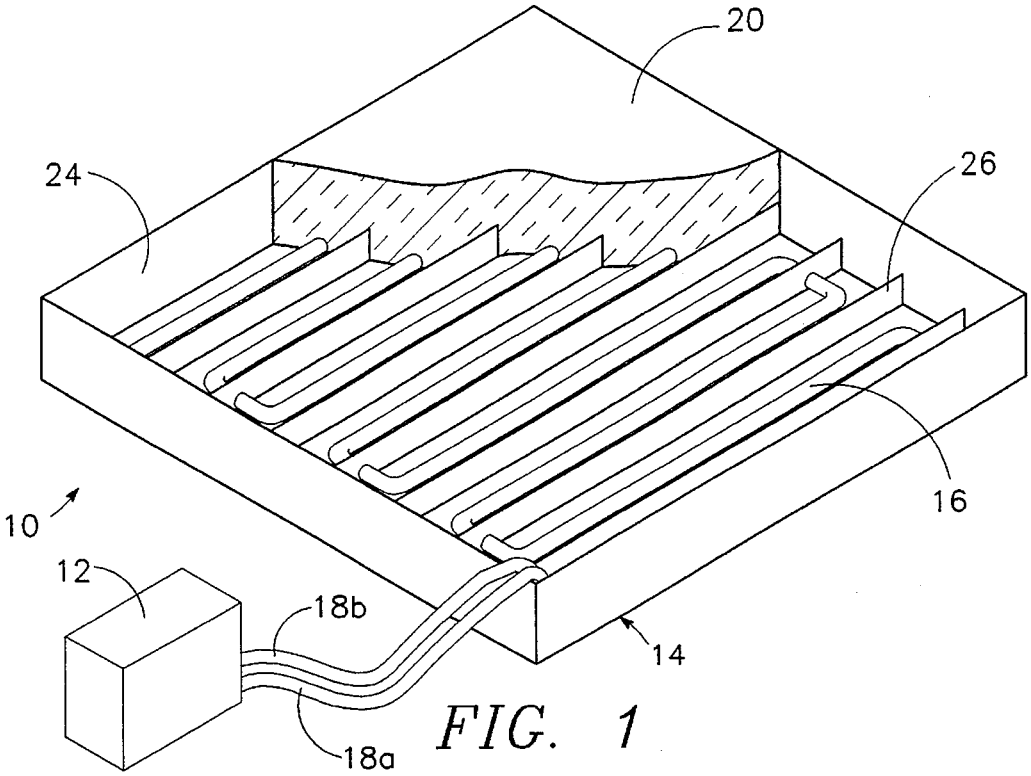
FIG. 1 is a perspective view of a heated concrete form of the present invention shown connected to a supply of heated fluid.
Figure 2:
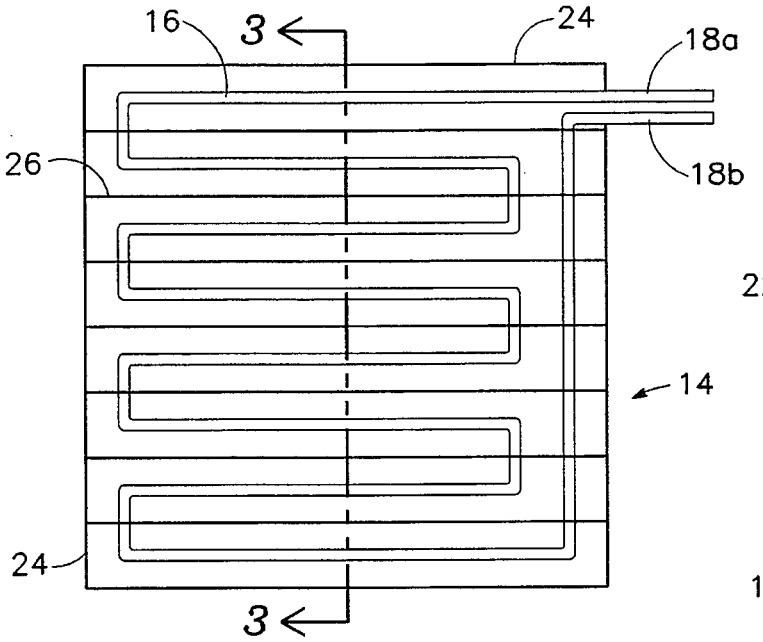
FIG. 2 is a plan view of the back of the heated concrete form showing the tubing channels through which a heated fluid flows.

Illustrated in FIG. 1 generally at 10 is a system for heating curing concrete, including a portable heater and pump 12, a concrete form 14, and a network of tubing 16 applied to the back or non-working side of the concrete form 14. The network of tubing 16 is put in fluid communication with the heater and pump 12 by a pair of connecting hoses **18*a* and 18*b*. Insulative material 20 covers the back side of the form 14 overlying the network of tubing 16**.

The concrete form 14 illustrated in FIG. 1 is a reusable metal concrete form as is in common use in the industry. Although a metal concrete form is described in the preferred embodiment, and is the most widely used form, any form material that would permit reasonable heat conduction could be used. The concrete form 14 has a substantially flat and continuous working face 22 (FIG. 3) which is placed in contact with the curing concrete and serves as the forming surface of the concrete form 14. The back or non-working side of the concrete form 14 includes a perimeter flange 24 and a plurality of parallel, spaced-apart stiffening ribs 26 which extend generally perpendicularly from the back side of the concrete form 14. The perimeter flange 24 and strengthening ribs 26 not only strengthen and provide rigidity to the concrete form 14, but also assist in assembling a plurality of concrete forms and securing the same into a concrete form assembly as are widely used in the industry for the pouring of a wide variety of concrete structures.

The network of tubing 16 is arranged on the back side of the concrete form 14 in a regular pattern to provide relatively uniform heat distribution across the concrete form 14. In the preferred embodiment, the network of tubing 16 is arrayed in a series of linked, open rectangles, but any arrangement which results in relatively even heat distribution given the particular geometry of any selected concrete form can be used. As illustrated in FIG. 1, the tubing 16 has relatively long longitudinal runs substantially parallel to the strengthening ribs 26 and short transverse runs wherein a length of tubing extends through an aperture in the associated strengthening rib 26.

It is not uncommon in metal concrete forms of the type illustrated to include apertures at regular spaced intervals in both the perimeter flange 24 and strengthening ribs 26. These apertures are used both to lighten the concrete form and to provide attachment sites for assembling a plurality of forms and attaching a variety of accessory equipment. The tubing 16 may pass through either these existing apertures or through apertures expressly made for this purpose. The network of tubing 16 should be positioned in contact with, or at least closely adjacent to, the back side of the concrete form 14 over a substantial portion of its length to provide for efficient transmission of heat from the network of tubing 16 to the concrete form 14. In the preferred embodiment, the concrete form 14 is steel and the tubing 16 is plastic and is securely attached to the back side of the form 14 by spring clips and a sand and cement mortar mix around the tubing. Of course, the concrete form 14 and tubing 16 can be made of any compatible materials depending on the application and acceptable cost and performance of the system 10. For example, while copper tubing would have high thermal conductivity and would improve the efficiency of heat transfer from the network of tubing 16 to the concrete form 14, it is relatively expensive. Other tubing materials, such as PVC (polyvinyl chloride) is less expensive, but would be less efficient at transporting heat to the concrete form 14. Additionally, tubing of a circular cross section is more readily available and will function well in most applications. However, tubing having a square cross section or at least one flat side that could be placed adjacent to the back side of the concrete form 14 will enhance the transfer of heat from the tubing 16 to the concrete form 14.

The heater and pump 12 provides a supply of pressurized heated fluid to the network of tubing 16 through the connector hoses 18. The working fluid can be of any composition consistent with the material used for the network of tubing 16 and suited for the particular environmental conditions where the system 10 is to be used. For example, if the system 10 is to be used for accelerating the strength gain of curing concrete in a non-freezing environment, plain water could be used as the working fluid. More typically, however, the system 10 would be employed to warm curing concrete in an environment that is below the freezing point of water. In such circumstances, it is preferable to use a fluid which has a low freezing point, such as water combined with an antifreeze such as ethylene glycol.

Figure 3:
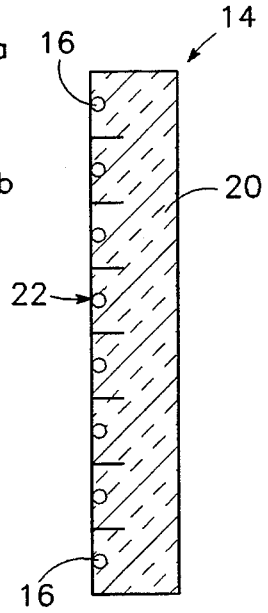
FIG. 3 is a cross-sectional view taken along the line 3—3 of FIG. 2.

As illustrated in FIGS. 1 and 3, the back side of the concrete form 14 is covered with a layer of insulating material 20 which will act to prevent heat loss from the back side of the concrete form 14 during use. The insulating material 20 is preferably removable from the back side of the form 14 to provide access to the perimeter flange 24 for ease in assembly of a plurality of such concrete forms into a concrete form assembly. Alternatively, the insulating material 20 may be flexible and not permanently attached to the back side of the form 14 around the perimeter area so that an operator could displace the insulating material 20 in the area of the perimeter flange 24 to gain access to the back side of the form for the purpose of assembling such forms together into a concrete form assembly.

It is preferable to arrange the network of tubing 16 in a pattern which will allow the convenient interconnection of a plurality of forms so that heated fluid from a single heater and pump 12 can be used to heat a plurality of concrete forms 14. In the concrete form 14 illustrated in FIG. 1, fluid flows out of the heater and pump 12, through the connecting hose **18*a* and into the network of tubing 16 at one corner of the concrete form 14. The fluid will then exit the concrete form 14 at the outflow of the network of tubing 16 through connecting hose 18*b* at the same corner of the concrete form 14. A similarly constructed concrete form adapted for use in the system can be placed adjacent to the outlet of the network of tubing 16 and connected thereto with the appropriate plumbing connections. The return line 18*b* (not shown) would then interconnect the outflow of the network of tubing 16 of the last concrete form in the series back to the heater and pump 12. The number of form sections which may be joined together and heated by a single heater and pump 12 is limited by the geometry of the concrete form assembly, the capacity of the heater and pump 12**, and the ambient environmental conditions.

Figure 4:
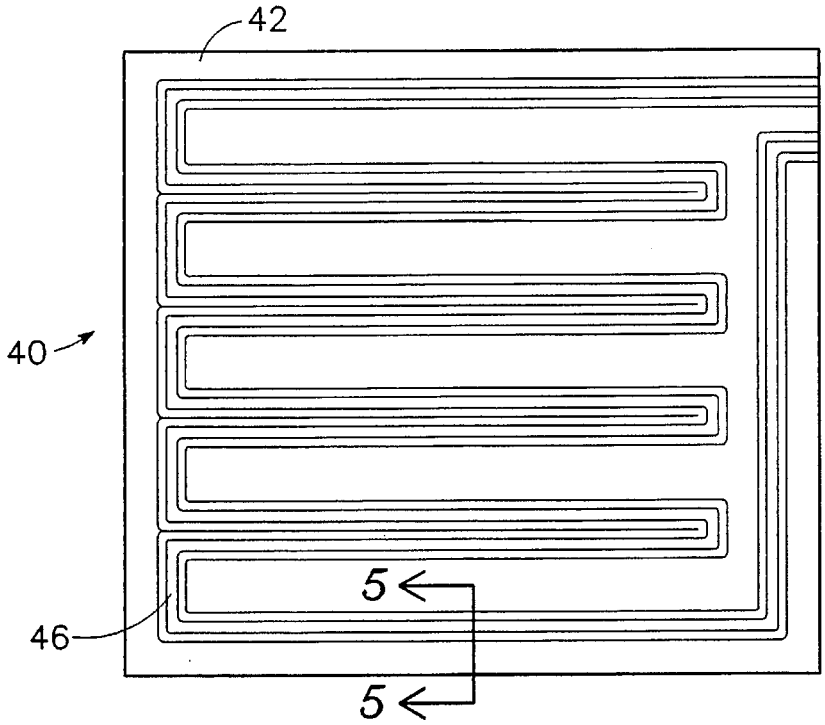
FIG. 4 is a plan view of an alternative embodiment comprising a flexible blanket for heating curing concrete.
Figure 5:
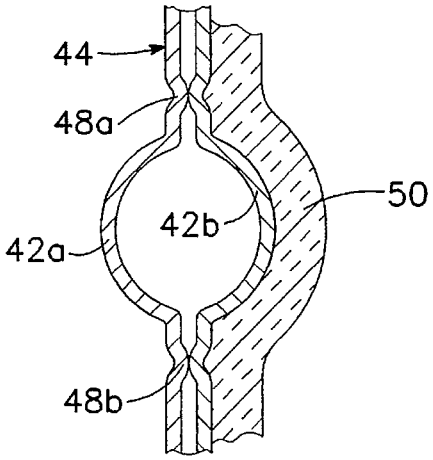
FIG. 5 is a cross-sectional view taken along line 5—5 of FIG. 4.
Figure 6:
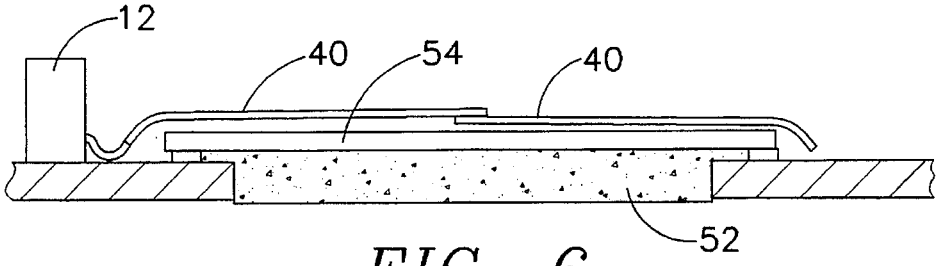
FIG. 6 is an elevational view of a pair of the flexible blankets shown in working position supported above a freshly poured concrete slab and shown connected to a source of heated fluid.

A second preferred embodiment of the invention is illustrated in FIGS. 4–6, generally at 40. The system 40 includes a flexible blanket 42 which has a front or working surface 44 made of a durable, flexible material such as sheet polyvinyl chloride. A network of tubing 46 is arranged on the back or non-working side of the flexible blanket 42 in a pattern which provides relatively even heat distribution to the entire working surface of the flexible blanket 42.

In the second preferred embodiment, as illustrated in FIG. 5, the network of tubing 46 is constructed from a pair of sheets **42*a* and 42*b* of flexible material, such as sheet polyvinyl chloride, which have been welded together, such as by ultrasonic welding or the like, along lines 48*a* and 48*b* to create therebetween a sealed volume interior to both of the sheets. The weld lines 48*a* and 48*b* run substantially parallel to each other, tracing the desired pattern as illustrated in FIG. 4. The network of tubing 46 thus created functions similarly to the network of tubing 16 described with respect to the first preferred embodiment above in that heated fluid entering one end of the network of tubing 46 will circulate throughout the network and exit from the outlet of the network of tubing 46 for flow either to an adjacent similar blanket 42 or concrete form 14 or return to the heater and pump 12 (FIG. 6**). Alternatively, a single sheet of flexible material could be used and system of tubing attached thereto, as in the first preferred embodiment. Preferably, the tubing would be flexible to allow the blanket to conform to a variety of surface geometries.

A layer of flexible insulating material 50 (FIG. 5) is applied over the entire back surface of the flexible blanket 42 covering the network of tubing 46 to reduce the undesired heat loss through the back side of the heating blanket 42.

The flexible heating blankets 42 are particularly suited for use in heating slabs of freshly poured concrete 52 such as is illustrated in FIG. 6. The slab 52 has a substantial top surface area that is not covered by any concrete form but rather was created by non-fixed form methods, such as slip forming, hand finishing, or the like. The large, uncovered surface area admits to relatively rapid heat loss and cooling. A plurality of heating blankets 40 are arranged over the curing slab 52 and are supported a small distance above its top surface by a plurality of ribs or beams 54. The flexible blankets 40 overhang the side edges of the beams 54 to limit the flow of ambient air under the blankets 42. Heated fluid from the heater and pump 12 is pumped through the heating blankets 42 to maintain the desired temperature in the area of the curing slab 52.

Although the invention has been described with respect to a preferred embodiment thereof, it is to be also understood that it is not to be so limited since changes and modifications can be made therein which are within the full intended scope of this invention as defined by the appended claims.

EXAMPLE

A pair of metal concrete forms constructed according to the first preferred embodiment were used ill the assembly of a concrete form system for pouring a concrete wall with a thickness of 225 mm. Identical metal concrete forms but without the tubing were used in the assembly of a concrete form system also for pouring a concrete wall with a thickness of 225 mm. In the conventional or control system, one-half of the form assembly was insulated on both sides identically to the form assembly to be heated according to the present invention, and the other one-half was left uninsulated. Accordingly, the curing concrete was subject to the three conditions of (a) heated and insulated according to the present invention (using R20 fiberglass batt insulation), (b) insulated but unheated (same R20 batt insulation), and (c) unheated and uninsulated.

Figure 7:
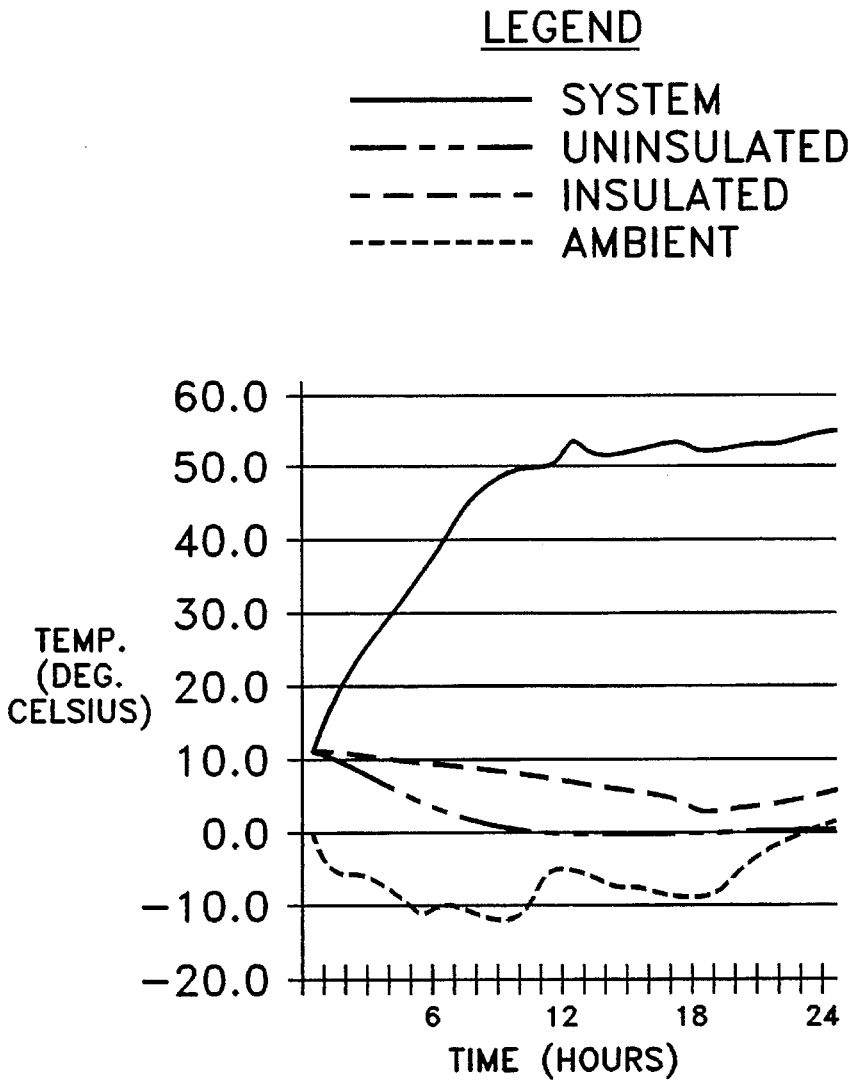
FIG. 7 is a graphical representation of test results comparing the temperature of concrete over 24 hours while curing in forms heated in accordance with the teachings of the invention, in insulated but unheated forms, and in unheated and uninsulated forms.

The two sets of forms were filled with the same batch of concrete at substantially the same time. Concrete and ambient air temperature measurements were taken at regular intervals throughout a 24-hour test period. The measurements are plotted in the graph of FIG. 7. In situ concrete strengths, using the LOK TEST method, were measured at 16, 24 and 48 hours after the pour. The results are set out in Table 1.

TABLE 1

| | 16 Hours | 24 Hours | 48 Hours |
|---|---|---|---|
| Heated and Insulated | 11.3 (45%) | 15.3 (61%) | 18.4 (74%) |
| Unheated and Insulated | 0 | 0 | 5.0 (2%) |
| Unheated and Uninsulated | 0 | 0 | 0 |

Strengths are given in MPA (mega pascals or newtons per square millimeter) and percentages of the specified 28-day strength. Although 25 MPA concrete was specified, and this number was used in the percentages in Table 1, 20 liters of water was added per cubic meter of the 25 MPA concrete which would be expected to reduce the MPA to a 28-day strength of 20 to 22 MPA. It should be noted that the uninsulated concrete froze.

What is claimed is:

1. An apparatus to aid in the curing of concrete, comprising:

(a) a heat transfer apparatus;

(b) a liquid capable of transferring heat;

(c) a metal concrete form panel having a working front side against which is formed uncured concrete and a back side opposite of said working front side, said form panel also having a plurality of strengthening ribs extending from said back side;

(d) an air and liquid impermeable conduit being of a construction to receive said liquid after said liquid has been passed through said heat transfer apparatus, said conduit being placed in thermal contact with said back side of said concrete forming panel to allow transfer of heat by conduction between said liquid and said uncured concrete to aid in the curing of said concrete; and (e) insulation operably connected to said conduit, said insulation being capable of reducing heat transfer from said liquid other than between said liquid and said concrete.

2. Apparatus as defined in claim 1, wherein said metal concrete form is of a generally open box-shape wherein an opening is defined by a perimeter flange extending from said back side through which access is gained to said conduit, and wherein said insulation is removably inserted inside said perimeter flange overlying said back side and said conduit.

3. Apparatus to aid in the curing of uncured concrete, comprising:

(a) a heat exchanger;

(b) a liquid capable of transferring heat with said uncured concrete;

(c) a first flexible sheet;

(d) a second flexible sheet interconnected to said first flexible sheet along at least two substantially parallel tracks to create a conduit between said tracks, and wherein said second flexible sheet is insulated;

(e) means for circulating said liquid from said heat exchanger through said conduit;

(f) said first flexible sheet being within sufficient proximity of said uncured concrete to allow heat to pass between said first flexible sheet and said uncured concrete; and (g) said first flexible sheet being of a construction which allows said heat to pass between said fluid and said uncured concrete.

* * * * *